US006683296B2

(12) United States Patent
Miller et al.

(10) Patent No.: US 6,683,296 B2
(45) Date of Patent: Jan. 27, 2004

(54) SENSOR SYSTEM FOR CONTROLLING MOVEMENT OF A DOOR USING A TIME-DELAY FAILURE SIGNAL

(75) Inventors: Bearge D. Miller, West Grove, PA (US); Gary Leigh, Kennett Square, PA (US); Michael Anderson, Lititz, PA (US); Timothy Castello, West Chester, PA (US)

(73) Assignee: Miller Edge, Inc., West Grove, PA (US)

( * ) Notice: Subject to any disclaimer, the term of this patent is extended or adjusted under 35 U.S.C. 154(b) by 87 days.

(21) Appl. No.: 09/951,573

(22) Filed: Sep. 13, 2001

(65) Prior Publication Data

US 2003/0047670 A1 Mar. 13, 2003

(51) Int. Cl.[7] ..... E02F 15/20

(52) U.S. Cl. ..... 250/221; 340/545.3; 318/468; 49/26

(58) Field of Search ..... 250/227.32, 221, 250/227.11, 342; 340/545.3, 552, 555, 545.1, 540, 541; 49/26, 28, 31; 318/468

(56) References Cited

U.S. PATENT DOCUMENTS 4,301,621 A * 11/1981 Houweling ..... 49/27
4,823,010 A * 4/1989 Kornbrekke et al. ..... 250/341.7
4,944,116 A * 7/1990 Mewald ..... 49/27
5,079,417 A * 1/1992 Strand ..... 250/221
5,259,143 A * 11/1993 Mitchell et al. ..... 49/27
RE34,665 E * 7/1994 Strand ..... 250/221
5,399,851 A * 3/1995 Strand ..... 250/222.1
5,426,293 A * 6/1995 Miller et al. ..... 250/221
5,689,236 A * 11/1997 Kister ..... 340/545.1
5,728,984 A * 3/1998 Miller ..... 200/61.43
6,114,956 A * 9/2000 Van Genechten ..... 340/552
6,181,095 B1 * 1/2001 Telmet ..... 318/480
6,396,010 B1 * 5/2002 Woodward et al. ..... 200/61.43

* cited by examiner

*Primary Examiner*—Stephone B. Allen
(74) *Attorney, Agent, or Firm*—Akin, Gump, Strauss, Hauer & Feld, LLP

(57) ABSTRACT

A sensing edge for controlling movement of a door by actuation of a device upon an external force being applied to the sensing edge includes an elongated generally flexible tubular sheath secured to the leading edge of the door. The sheath has a longitudinal axis generally parallel to a leading edge of the door and includes an elongated hollow cavity extending generally parallel to the longitudinal axis, a first open end and a second open end. The sensor system includes a transmitter near the first end of the sheath for transmitting a signal through the cavity toward the second end of the sheath. The sensor system also includes a receiver near the second end of the sheath in alignment with the transmitter for detecting a signal at the second end and for generating an output signal upon detection of an absence of the signal when the passage of the signal through the cavity is blocked. The sensor system also includes a control circuit coupled to the receiver for receiving the output signal from the receiver and for sending a failure signal to the device only if no signal is received by the receiver for a predetermined time.

14 Claims, 9 Drawing Sheets

SENSOR SYSTEM FOR CONTROLLING MOVEMENT OF A DOOR USING A TIME-DELAY FAILURE SIGNAL

BACKGROUND OF THE INVENTION

The present invention relates generally to sensor systems, and more particularly, to an improved sensor system including a door sensing edge having an infrared or photoelectric transmitter and receiver with a control circuit capable of reducing detection errors due to noise.

Conventional sensing edges generally include a sheath having a cavity formed along the length of the sheath wherein at least a portion of a switch is located. The sensing edge is attached to an edge of a door which may be moved in different directions. When external pressure is applied to the sheath of the sensing edge, the switch is activated. The activated switch actuates a door control device, which in turn causes the door to either stop moving or to open. For example, the external pressure may be applied to the sheath when the sheath contacts an obstructing article such as a tool or a portion of the body of a person, located between the sensing edge and an opposed surface. By stopping or changing the direction of movement of the door, damage to the obstructing article may be prevented.

Many types of conventional sensing edges that operate generally as described above are in existence today. For example, a first conventional sensing edge includes a photoelectric switch comprising a light transmitter and a light detector. The light transmitter and the light detector are positioned a predetermined distance below a leading edge of a door and at opposite ends of the leading edge such that the light transmitter transmits a light beam across the length of the door toward the light detector. The light beam is blocked from reaching the light detector when an article obstructs the downward movement of the door. When the light detector senses the absence of the light beam, the light detector sends a signal to a door control device, which in turn causes the door to either stop moving or to open.

The first conventional sensing edge is flawed because the light transmitter and light detector are not contained within a protective covering, such as a sheath. Therefore, the light transmitter and the light detector are subject to damage from natural forces (such as rain, wind, snow, etc.) and artificial forces (such as misdirected balls, errant bicycles, maliciously thrown rocks, etc.).

A second conventional sensing edge described in U.S. Pat. No. 5,426,293, which is incorporated by reference herein, includes a device for controlling movement of a door by actuation of the device upon an external force being applied to a sensing edge. The sensing edge includes an elongated, generally flexible tubular sheath which is secured to a leading edge of the door. The sheath includes an elongated hollow cavity with an optically reflective interior surface. A light transmitter is positioned proximate a first end of the sheath for transmitting a light beam toward a second end of the sheath. A light detector is positioned proximate the second end of the sheath for detecting the presence or absence of the light beam at the second sheath end. The light detector generates a signal for actuating the device upon detecting the absence of the light beam at the second end of the sheath.

The second conventional sensing edge is flawed because light detectors often detect noise and other short term transients, not due to actual obstructions in the path of the leading edge of the door. Such noise and other transients, which are detected instantly, causes the device to actuate the door erroneously.

What is required is a sensing edge having a photoelectric sensor system including a transmitter and a receiver (light wave or infrared), wherein the transmitter and the receiver have noise and transient immunity provided by a specially designed control circuit.

BRIEF SUMMARY OF THE INVENTION

Briefly stated, the present invention comprises a sensor system for controlling movement of a door moving in a first direction by actuation of a device. The sensor system includes an elongated generally flexible tubular sheath secured to a leading edge of the door, the sheath having a longitudinal axis generally parallel to the leading edge of the door and including an elongated hollow cavity extending generally parallel to the longitudinal axis, a first open end, and a second open end. An infrared transmitter is located near the first end of the sheath for transmitting an infrared signal toward the second end of the sheath through the cavity. An alternate embodiment may include a light wave transmitter in lieu of the infrared transmitter. The sensor system also has an infrared receiver near the second end of the sheath in alignment with the infrared transmitter for detecting the infrared signal at the second end, and for generating an output signal upon detecting an absence of the infrared signal when the passage of the infrared signal through the cavity is blocked. If the transmitter is a light wave transmitter, then the receiver may be a light wave receiver in place of an infrared receiver. The sensor system may alternatively use any electromagnetic emitter as a transmitter and a corresponding electromagnetic detector as a receiver, such as radio wave, microwave, x-ray, and the like. The sensor system also has a control circuit coupled to the receiver for receiving the output signal from the receiver and for sending a failure signal to the device only if no signal is received by the receiver for a predetermined time period.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
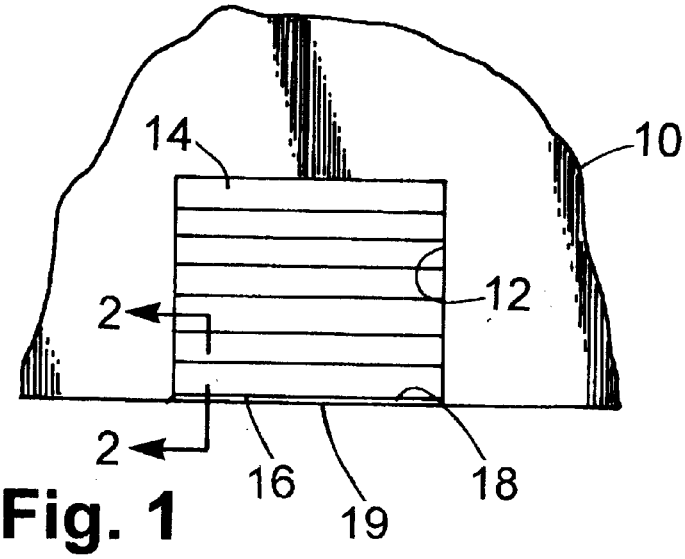
FIG. 1 is a front elevation view of a door construction including a sensing edge in accordance with a preferred embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the object discussed and designated parts thereof. The terminology includes the words above specifically mentioned, derivatives thereof and words of similar import. Additionally, the word "a" is used in the claims and in the corresponding portions of the specification, means "at least one."

Referring to the drawings in detail, wherein like reference numerals indicate like elements throughout, there is shown in FIG. 1 a wall 10 having a doorway opening 12 provided with a door 14. For purposes of illustration, the door 14 is shown as an overhead door having a sensing edge 16 along its lower side or leading edge 18. When the door 14 is fully closed (as shown in FIG. 1), the leading edge 18 is adjacent to and contacts an opposed surface 19 or a floor. However, one of ordinary skill in the art would understand that the sensing edge 16 may be located along any edge of any door structure, such as vertically or horizontally movable doors (not shown), without departing from the spirit and scope of the present invention.

Figure 3:
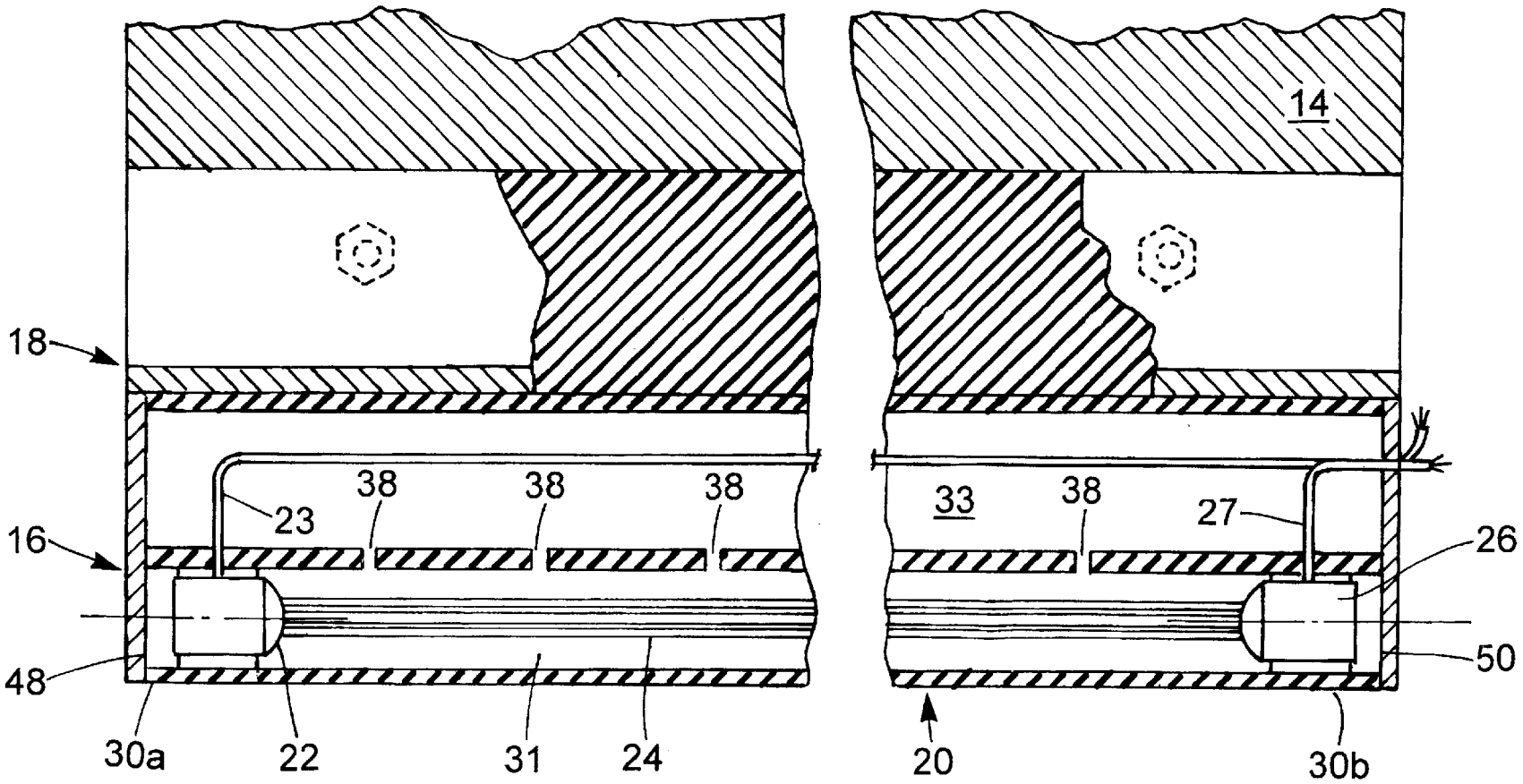
FIG. 3 is a cross-sectional view of a portion of the door and the sensing edge of FIG. 1 taken along line 3—3 of FIG. 2.

As shown in FIG. 3, the sensing edge 16 extends substantially along the entire length of the leading edge 18 of the door 14. The sensing edge 16 controls movement of the door 14 by actuating a door control device 80 shown in FIGS. 7A and 7B upon an external force being applied to the sensing edge 16. As shown in FIG. 1, the door 14 is capable of movement in a generally vertical direction in a plane generally parallel to that of the wall 10. The invention is not limited to doors only moving in the vertical direction, and may also include doors that move horizontally or in other directions. For example, when the door 14 and sensing edge 16 are moving in a generally downward direction, if the sensing edge 16 encounters an obstructing article (not shown) at the leading edge 18, the sensing edge 16 senses the obstructing article and actuates the door control device 80 to stop or change the direction of movement of the door 14, i.e., to a generally upward direction or open door position and thereby avoid damage to the obstructing article or the door which could result if the door continued to move downwardly.

Figure 2:
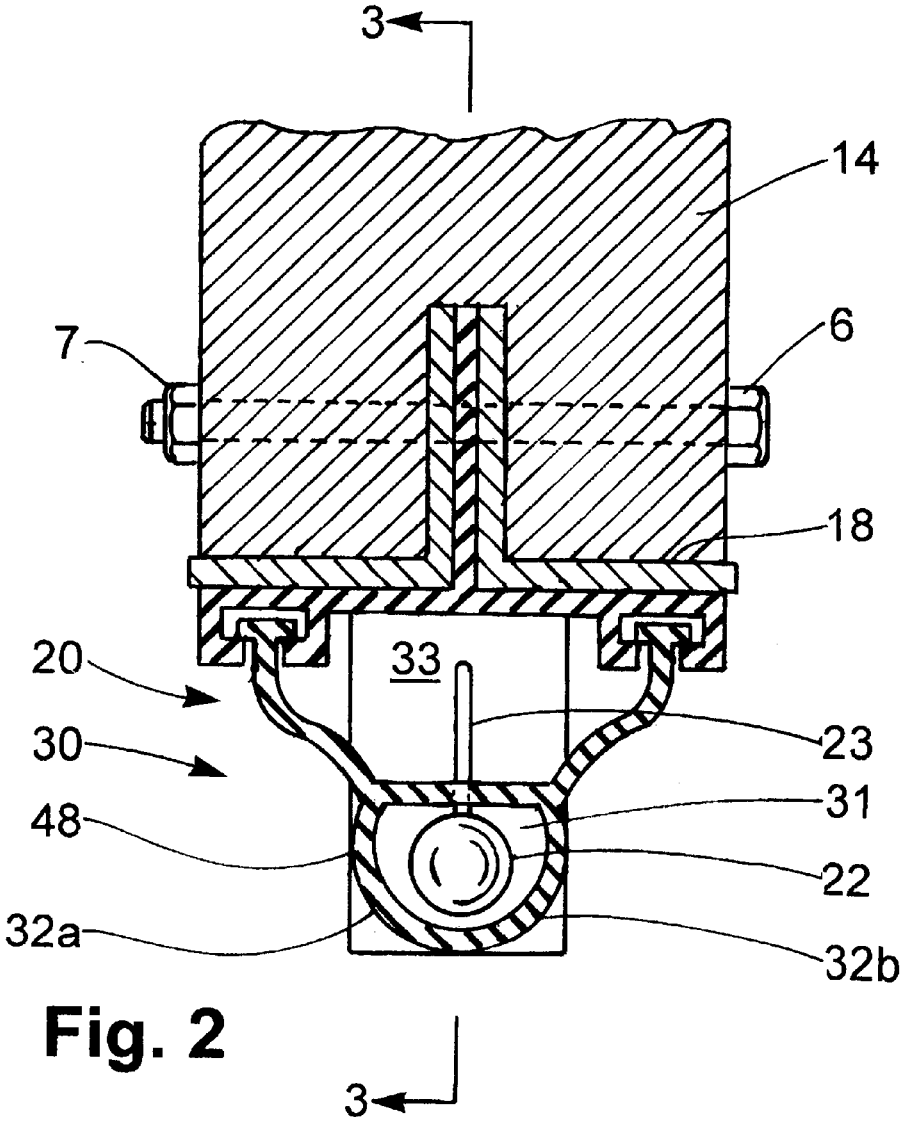
FIG. 2 is a greatly enlarged sectional view of a portion of the door and the sensing edge of taken along line 2—2 FIG. 1.

FIGS. 2 and 3 further show a sensor system 20 for controlling movement of a door 14 moving in a first direction by actuation of a device 80. The sensor system 20 has an elongated generally flexible tubular sheath 30 secured to a leading edge 18 of the door 14. The sheath 30 has a longitudinal axis generally parallel to the leading edge 18 of the door 14 and includes an elongated hollow cavity 31 generally parallel to the longitudinal axis. The tubular sheath 30 further includes a first open-end 30*a* and a second open-end 30*b*. The sheath 30 may be formed from any flexible elastomeric material such as polyvinyl chloride (PVC), neoprene, polyurethane, polyethylene, or the like. It is desirable to select a base material for the sheath 30 that has intrinsic reflectivity so that the sheath 30 does not need to be lined with a reflective material or coating. The sheath 30 may be formed by extrusion molding dye molding, milling, or any other well-known method. The sheath 30 may be formed from other materials with other characteristics and by other processes without departing from the spirit and scope of the invention.

Figure 6:
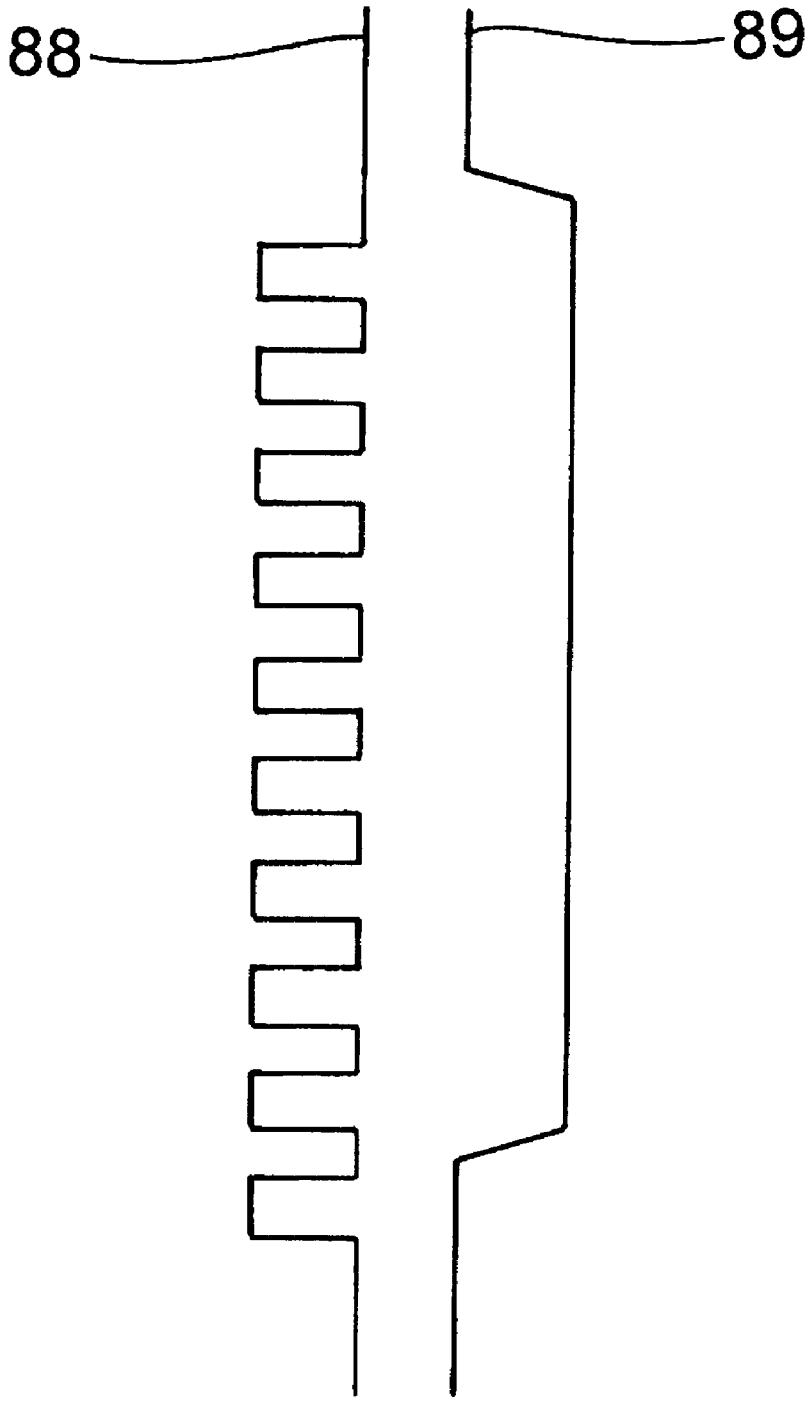
FIG. 6 is a timing diagram of the transmitter and receiver in accordance with a preferred embodiment of the present invention.

The sensor system 20 also includes an infrared transmitter 22 proximate the first end 30*a* of the sheath 30 for transmitting an infrared signal 24 toward the second end 30*b* of the sheath 30 through the cavity 31. The sensor system 20 also has an infrared receiver 26 proximate the second end 30*b* of the sheath 30 in alignment with the infrared transmitter 22 for detecting the infrared signal 24 at the second end 30*b* of the sheath 30, and for generating an output signal (not shown) upon detecting an absence of the infrared signal 24 when the passage of the infrared signal 24 through the cavity 31 is blocked. Infrared detectors typically work on the order of 880 to 940 nanometer wavelengths (nM). As is typical, infrared transmitters transmit infrared signals at a frequency between about 28 kHz and about 59 kHz. A very sensitive chopping rate (frequency or on/off modulation) for a transmitter is about 37.6 kHz. In the present embodiment, it is normal to send out a packet of ten pulses from the infrared transmitter 22 and then wait for a short time period to receive the packet of 10 pulses 88 at the infrared receiver 26 prior to setting an output 89 of the infrared receiver 26 as shown in FIG. 6.

In an alternate embodiment the infrared transmitter 22 may be a light wave transmitter (not shown) and the infrared receiver 26 may be a light wave receiver (not shown). Alternatively, the infrared signal 24 may be any electromagnetic emission such as microwave, radio wave, x-ray or the like employing suitable transmitters/receivers.

The sensing edge 16 also includes a generally rigid first block 48 secured within the cavity 31 for housing the infrared transmitter 22. The first block 48 is located proximate the first end 30*a* of the sheath 30. Preferably, the first block 48 is secured within the cavity 31 by frictional engagement with the lower surface of a first wall 32*a* of the sheath 30 and with the upper surface of a second wall 32*b* of the sheath 30, although those skill in the art will appreciate that the first block 48 can be secured within the cavity 31 using other well-known methods. The first block 48 is formed from a generally rigid material such as steel, aluminum, copper, high density polyethylene, neoprene, PVC, or the like. Because the first block 48 is made from a generally rigid material, the first block 48 itself is generally rigid, and therefore, the first block 48 does not collapse when the sheath 30 contacts the floor 19 or an obstructing object (not shown). Therefore, the first block 48 prevents damage to the infrared transmitter 22 when the sheath 30 contacts the floor 19 or an obstructing object.

The sensing edge 16 also includes a generally rigid second block 50 secured within the cavity 31 for housing the infrared receiver 26. The second block 50 is located proximate the second end 30*b* of the sheath 30. Preferably, the second block 50 is secured within the cavity 31 by frictional engagement with the lower surface of the first wall 32*a* and with the upper surface of the second wall 32*b*, although those skill in the art will appreciate that the second block 50 can be secured within the cavity 31 using other well-known methods. The second block 50 is formed from a generally rigid material such as steel, aluminum, copper, polyethylene, neoprene, polyvinyl chloride, or the like. Because the second block 50 is made from a generally rigid material, the second block 50 itself is generally rigid, and therefore, the second block 50 does not collapse when the sheath 30 contacts the floor 19 or an obstructing object. Therefore, the second block 50 prevents damage to the infrared receiver 26 when the sheath 30 contacts the floor 19 or an obstructing object.

The sheath 30 may also include an air passageway 38 comprising at least one hole formed in at least one wall of the sheath 30. The air passageway 38 allows air to pass between the hollow cavity 31 and preferably a secondary chamber 28 between the upper surface of the sheath 30 and the lower edge surface of the door 14. But, the air passageway 38 may simply be vented directly to the atmosphere. The air passageway allows air to freely escape from the hollow cavity 31 when the sheath 30 compresses due to external pressure being applied to the sheath 30. Thus, the compressibility of the sheath 30 is enhanced due to the operation of the air passageway and, consequently, the sensitivity of the sensing edge 16 to detect obstacles which come into contact with the sheath 30 is increased.

Figure 4A:
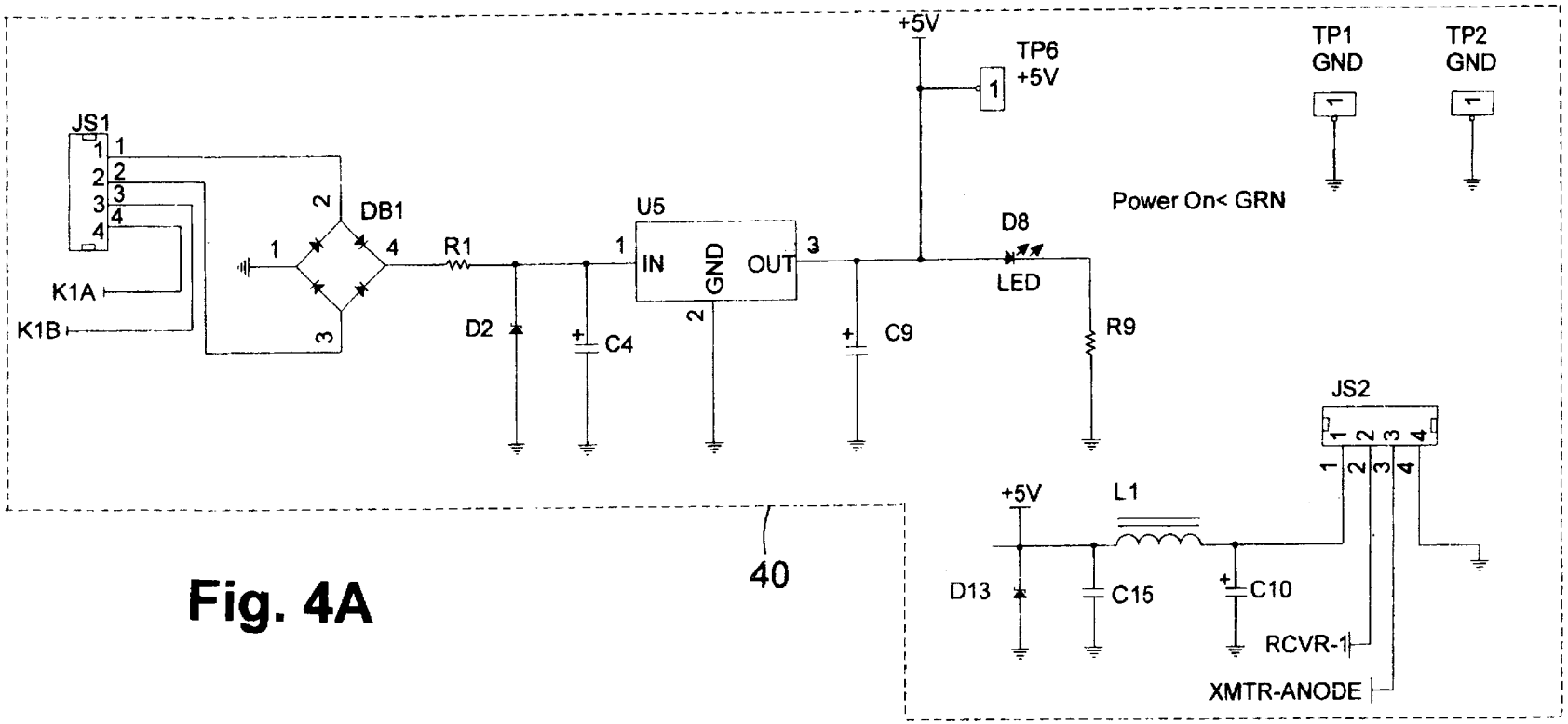
FIG. 4A is a schematic circuit diagram of a power supply circuit for a sensor system in accordance with a preferred embodiment of the present invention.
Figure 4B:
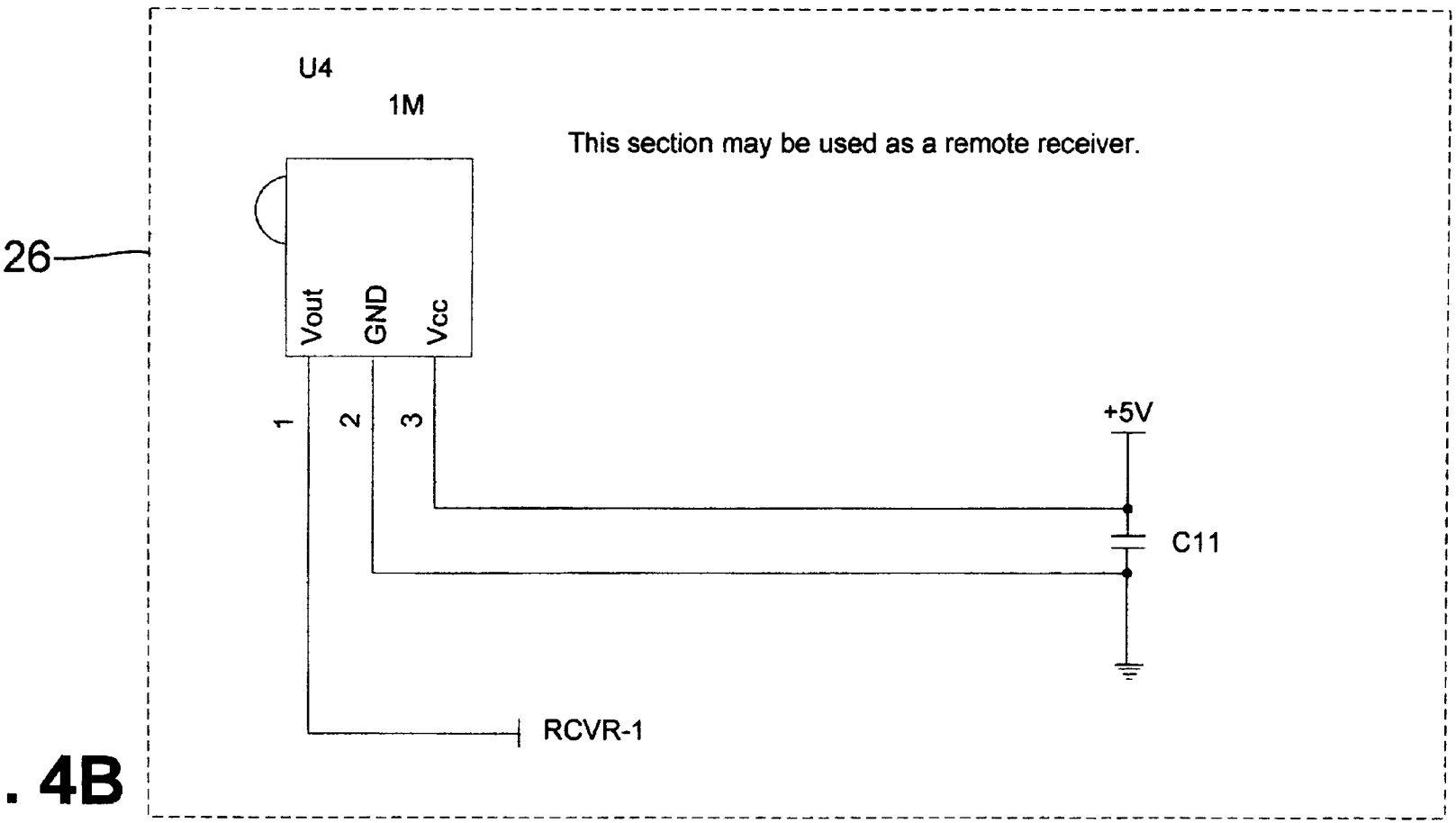
FIG. 4B is a schematic circuit diagram of a receiver circuit for a sensor system in accordance with a preferred embodiment of the present invention.
Figure 4C:
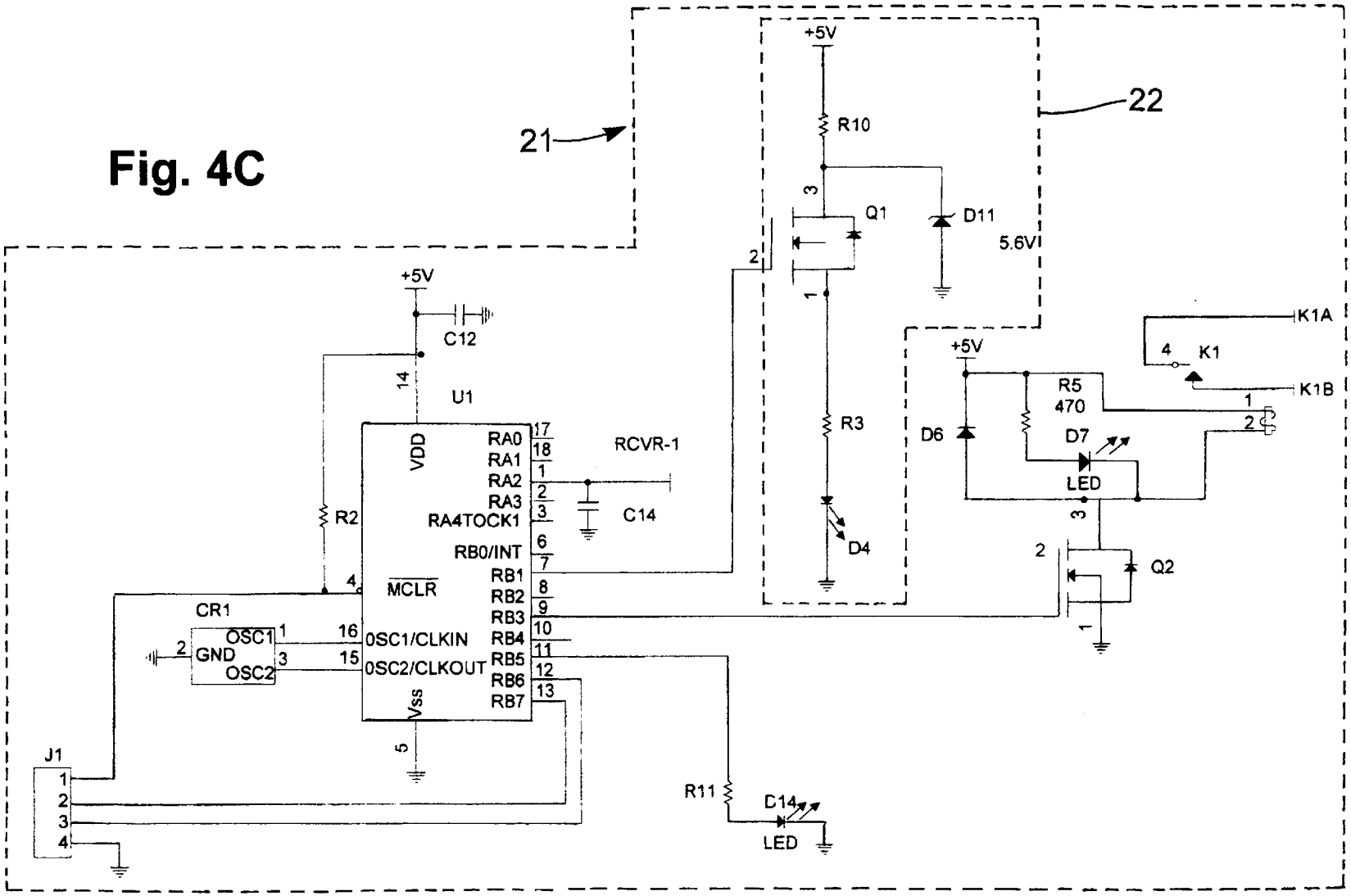
FIG. 4C is a schematic circuit diagram of a control circuit for a sensor system in accordance with a preferred embodiment of the present invention.

The sensor system 20 also has a control circuit 21, depicted in FIG. 4C, coupled to the infrared receiver 26 in the circuit of FIG. 4B for receiving the output signal from the infrared receiver 26 and for sending a failure signal to the device 80 only if no infrared signal 24 is received by the receiver 26 for a predetermined time period. The infrared signal 24 and the output signal (not shown) may both be binary. Further, the output signal may be a series of pulses each having a substantially similar width and a predetermined time between pulses, the pulses being generated only in the absence of the infrared signal 24 being detected by the receiver 26. In the present embodiment the control circuit 21 has a microcontroller U1 which includes at least one input for receiving the output signal from the infrared receiver 26. However, one of ordinary skill in the art would understand that the control circuit 21 may include an application specific integrated circuit (ASIC), a processor, a microprocessor, programmable array logic (PAL), or a combination of hardwired logic gates or the like. The microcontroller U1 in the control circuit 21 has at least one output for sending a failure signal to the device 80 that controls the door 14. The microcontroller U1 includes a program for counting continuously repeating pulses of the output signal from the infrared receiver 26 until a predetermined number of continuously repeating pulses accumulates and for causing the microcontroller U1 to send the failure signal to the device 80. By counting a number of pulses, the control circuit 21 reduces the possibility of sending out a failure signal based upon a false output signal. Additionally, the transmitter 22 may be set for a gain greater than one so that the transmitted signal 24 is stronger, enabling the sensor system 20 to detect signals over a greater distance and to compensate for deformities in the hollow cavity 31 of the sheath 30 caused by wobbles in the door 14. The sensor system 20 of the present invention, due to its ability to have an increased gain and error reduction, is not susceptible to problems or false signals due to lack of precise alignment between the infrared transmitter 22 and the infrared receiver 26, noise, transients or other problems.

FIG. 4A is a schematic circuit diagram of a preferred embodiment of a power supply circuit 40, for the present invention. The power supply circuit 40 comprises a voltage regulator IC U5, two Zener diodes D2, D13, a diode bridge rectifier DB1, a power-on light emitting diode (LED) D8, an inductance coil L1, and various biasing components C4, C9, C10, C15, R1, R9. In the present embodiment, the voltage regulator U5 is a National Semiconductor LM78M05C/TO and the diode bridge rectifier DB1 is a Diodes Incorporated™ HD04DICT. A voltage with a potential of between about 7 to about 25 VDC is supplied, from an external power source (not shown), to the diode bridge rectifier DB1 which in conjunction with the Zener diode D2 ensures that a proper polarity voltage is supplied to the input of the voltage regulator IC U5. The voltage regulator IC U5 is capable of regulating an input voltage between about 7 to about 25 VDC to an output voltage between about 4.7 to about 5.3 VDC, but ideally to an output voltage between about 4.8 to about 5.2 VDC with a typical value of 5.0 VDC. Once supplied with a regulated voltage from the voltage regulator IC U5, the LED D8 is illuminated indicating that the circuit has regulated power. The power supply circuit 40 supplies power at a regulated voltage to other devices in the related circuits depicted in FIGS. 4B and 4C, described in detail below. It should be obvious to one skilled in the art to substitute other similar voltage regulators, bridge rectifiers, and the like, having different nominal input and output values without departing from the scope of the invention. In normal operation, power is continuously supplied to the power supply circuit 40, which in turn continuously provides power to the other parts of the circuit through commonly available electrical conductors, wires, jumpers or the like.

FIG. 4B is a schematic circuit diagram of an infrared receiver 26 in accordance with the present embodiment. The infrared receiver 26 is supplied regulated power from the power supply circuit 40 at a voltage regulated between about 4.7 to about 5.3 VDC, but ideally to an output voltage between about 4.8 to about 5.2 VDC with a typical value of 5.0 VDC. Infrared receiver 26 includes an infrared receiver IC U4 and a filtering capacitor C11. The infrared receiver IC U4 in the present embodiment is a Panasonic PNA461 IM infrared Photo IC. The combination of the infrared receiver IC U4 and the filtering capacitor C11 provides the capability of detecting a 36.7 kHz modulated infrared signal 24 and outputting a low (zero) output as long as the modulated infrared signal 24 is detected. However, it should be obvious to one skilled in the art to substitute other similar infrared receiver IC's, photo-detector IC's, and the like having the same or different detection frequency capabilities without departing from the scope of the invention. It is desirable to select a receiver that has an extremely tight band-pass filter built into its internal circuitry or associated with it in order to reduce falsely detected occlusions of the signal due to noise. It is also important to select a receiver having a filter that passes signals which closely match the output of the associated infrared transmitter.

FIG. 4C is a schematic circuit diagram of a control circuit 21 in accordance with the present embodiment. The control circuit 21 is supplied regulated power from the power supply circuit 40 at a voltage regulated between about 4.7 to about 5.3 VDC, but ideally to an output voltage between about 4.8 to about 5.2 VDC with a typical value of 5.0 VDC. The control circuit 21 comprises a microcontroller U1, an external clock/crystal CR1, a relay K1, a relay driver transistor Q2, various resistors R2, R5, R11, various capacitors C12, C14 and the infrared transmitter 22. The control circuit 21 also includes two other LED's: one for indicating relay-energized D7 and one for indicating signal-acquired D14. The main logic of the control circuit 21 is provided by the microcontroller U1 which may or may not need to use the external clock/crystal CR1 as a logic time base. The microcontroller U1 in the present embodiment is a Microchip™ PIC16F84/SO microcontroller in combination with an external crystal CR1 modulated at 4 MHz. The particular microcontroller U1 includes on-chip FLASH memory for retaining the controlling programming code without external devices such as electronically programmable read only memory (EPROM's) or electronically erasable programmable read only memory (EEPROM's), or the like, but such devices may be used if desired. The relay K1, in the present embodiment, is a typical single pole single throw (SPST) dry contact type as is commonly known art; however, it would be obvious to one skilled in the art to substitute a variety of similar devices such as silicone controlled rectifiers (SCR's), power transistors, optical isolation devices, solid state switches, radio frequency transmitters, optical transmitters, and the like.

The infrared transmitter 22 includes an infrared transmitter driver transistor Q1, Zener diode D11, infrared LED D4 and biasing resistors R3, R10. In the present embodiment, the infrared LED D4 is a Unitech 1500C4DA-VFL, the infrared transmitter driver transistor Q1 is a 2N7000TO-92 transistor, and the Zener diode is a 1N5232. An output of the microcontroller U1 connected to the infrared transmitter 22 is specifically connected to the infrared transmitter driver transistor Q1. The output of the microcontroller U1 connected to the infrared transmitter 22 is driven by the controlling programming in the microcontroller U1 to send the packets of ten voltage pulses. Upon receiving the voltage pulses from the infrared transmitter driver transistor Q1, the infrared LED D4 transmits an infrared signal modulated at between about 20 kHz and 60 kHz but preferably at about 36.7 kHz. However, one of ordinary skill in the art would understand that any of the components could be substituted with other commonly available circuit devices without departing from the spirit of the invention.

Figure 5:
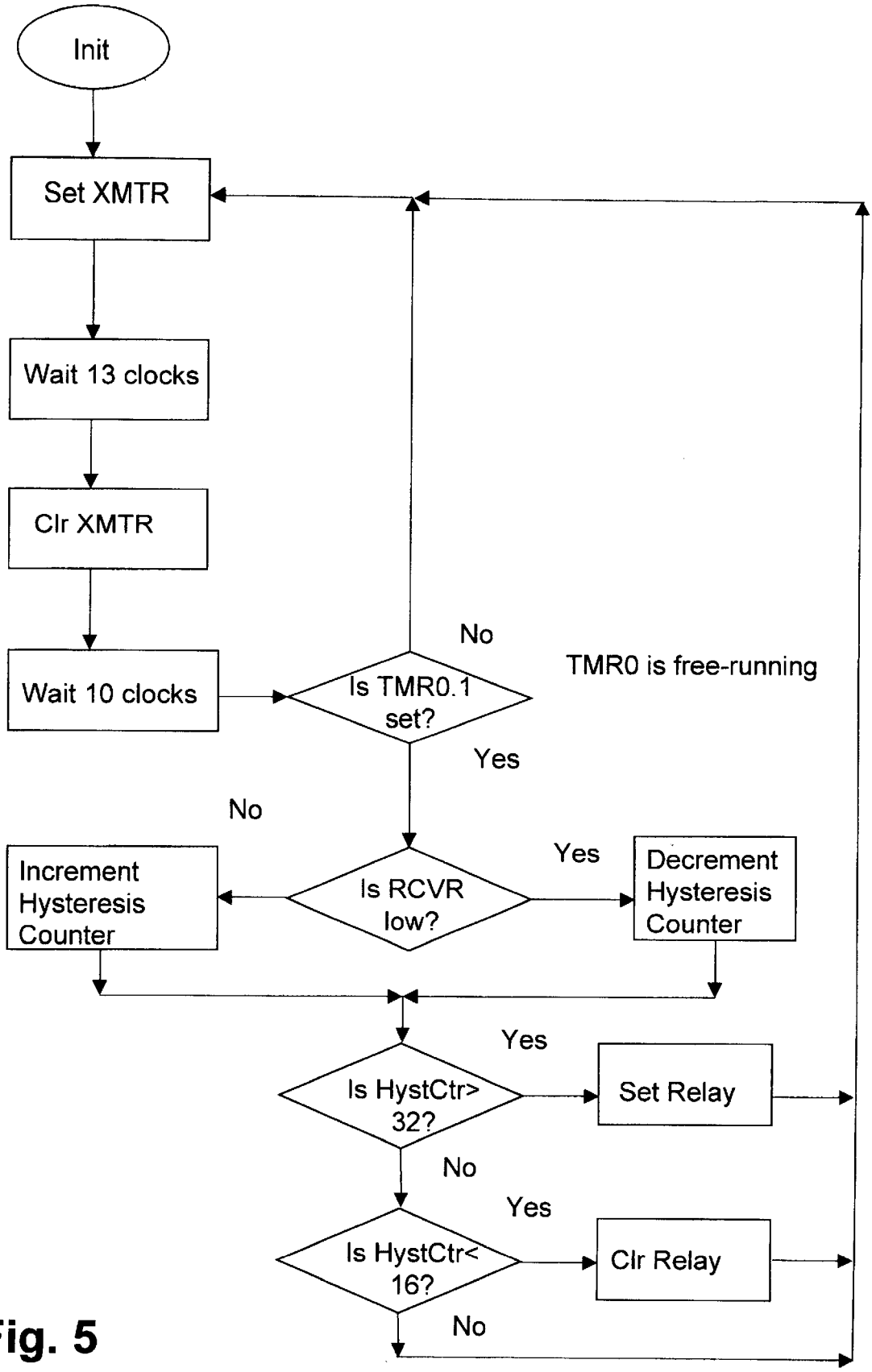
FIG. 5 is a flow diagram of a control program for a microcontroller of a preferred embodiment of the present invention.

FIG. 5 is a flow diagram of a control program for the microcontroller U1 of the control circuit 21 in accordance with the present embodiment. As shown, upon initialization, the output of the microcontroller U1 connected to the infrared transmitter 22 is set, and then thirteen clock cycles are counted. The output of the microcontroller U1 connected to the infrared transmitter 22 is then cleared and then after ten clock cycles, the processor tests if timer TMR0.1 is set. Setting the output of the microcontroller U1 connected to the infrared transmitter 22 for thirteen clock cycles and clearing the output of the microcontroller U1 connected to the infrared transmitter 22 for ten clock cycles creates the pulse train output 88 of the transmitter 22 as shown in FIG. 6, wherein the pulse width is approximately equal to the number of cycles the output of the microcontroller U1 connected to the infrared transmitter 22 is set. Timer TMR0.1 is a free running timer which sets its output when the timer TMR0.1 counts up to its preset. The preset for timer TMR0.1 is determined by the number of pulses desired per packet, in the present embodiment, the number of pulses is ten. Since TMR0.1 is free running the output is automatically cleared on the next program scan and the timer TMR0.1 begins counting up again without need for a particular program permissive. If timer TMR0.1 is not set, the output of the microcontroller U1 connected to the infrared transmitter 22 is set again and that process is repeated. However, if timer TMR0.1 is set, the input of the microcontroller U1 from the output signal of the infrared receiver 26 is tested to determine if it is low. If the input of the microcontroller U1 from the output signal of the infrared receiver 26 is low, a hysterisis counter is decrimented and the program then tests to determine if the hysterisis counter is greater than 32. If the hysterisis counter is greater than 32, then the output of the microcontroller U1 connected to the relay driver transistor Q2 is set which allows the relay driver transistor Q2 to drive relay K1, which in turn drives the failure signal to the device 80. The program then returns to setting the output of the microcontroller U1 connected to the infrared transmitter 22. However, if the hysterisis counter is not greater than 32 the program tests to determine if the hysterisis counter is less than 16. If the hysterisis counter is less than 16 then the output of the microcontroller U1 connected to the relay driver transistor Q2 is cleared. But if the hysterisis counter is not less than 16, the program returns to setting the output of the microcontroller U1 connected to the infrared transmitter 22. If the output signal from the receiver 26 is not low, then the hysterisis counter is incremented and testing of the hysterisis counter count is repeated. Minor modification to the number of counts or the ordering of the steps will be obvious to one of ordinary skill in the art without departing from the broad scope of the invention.

Figure 8B:
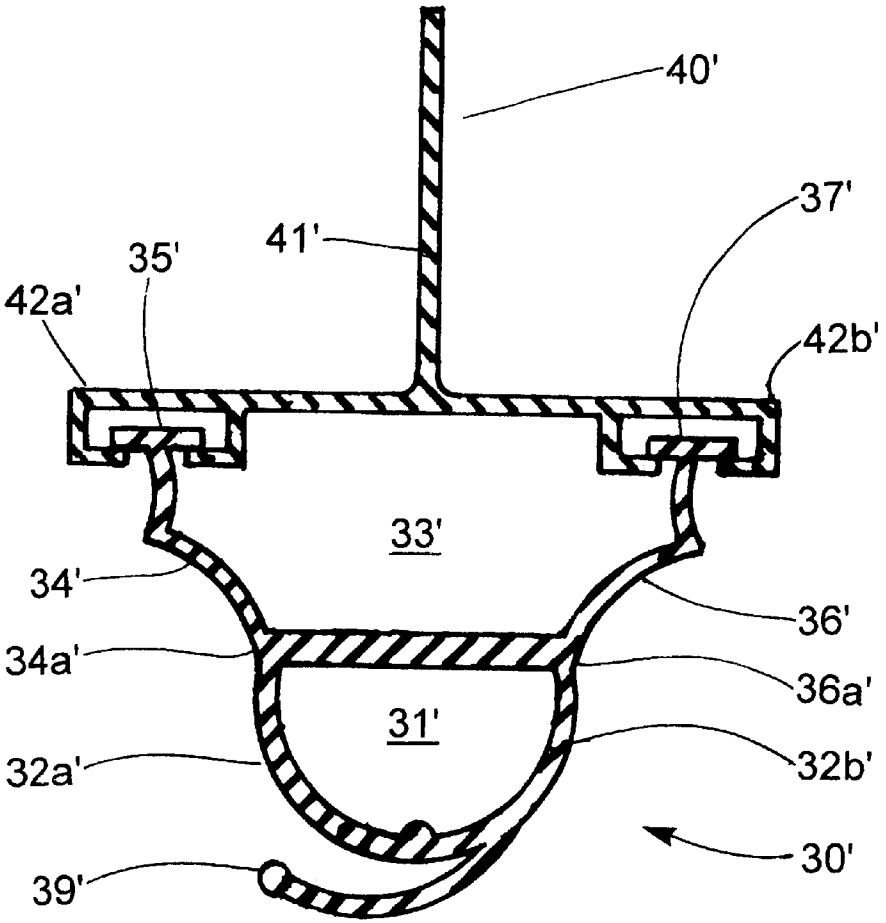
FIG. 8B is a cross-sectional view of the sheath of FIG. 8A mounted in a typical mounting bracket attached to a portion of the door.
Figure 8A:
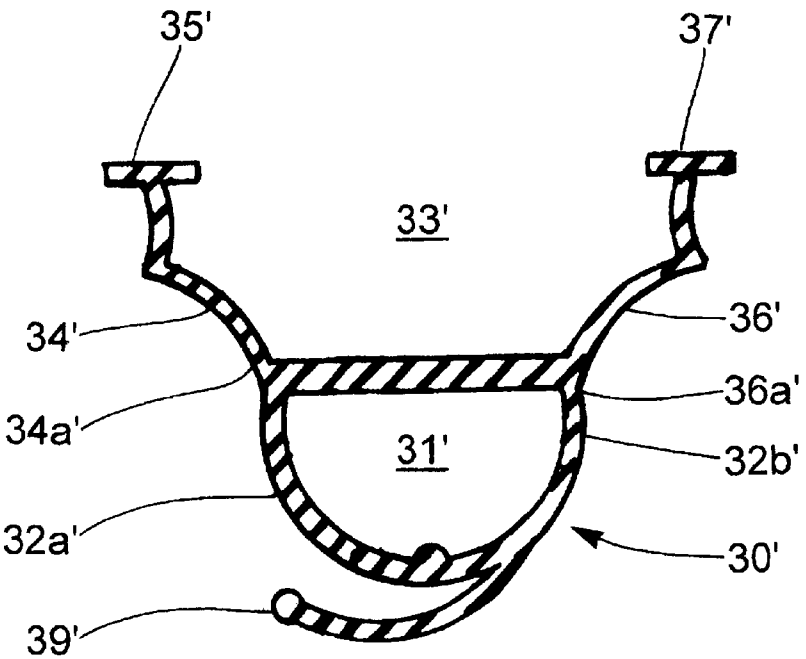
FIG. 8A is an enlarged cross-sectional view of a preferred embodiment of the sheath of the present invention.

FIG. 8A shows an alternate embodiment of a sheath 30' of the present invention. The sheath 30' has a first support element 34' and a second support element 36' each extending from opposite edges 34*a*', 36*a*' of the sheath 30' for securing the sheath 30' to the door 14. The sheath 30' also has a second elongated hollow cavity 33' for use as a wire way extending between first support element 34' and the second support element 36'. FIG. 8B shows how sheath 30' is attached to a mounting bracket 40' via a first attachment Tee 35' and a second attachment Tee 37'. The mounting bracket 40' has an upright flat member 41' extending in a longitudinal axis parallel to the leading edge 18 of the door 14. Further the mounting bracket 40' includes a first channel slot 42*a* and a second channel slot 42*b* for receiving the attachment Tees 35', 37', respectively. The tubular sheath 30' may include a flap 39' which engages the floor or other opposed surface 19 to prevent debris and the like from blowing under the door 14 when closed.

Figure 7A:
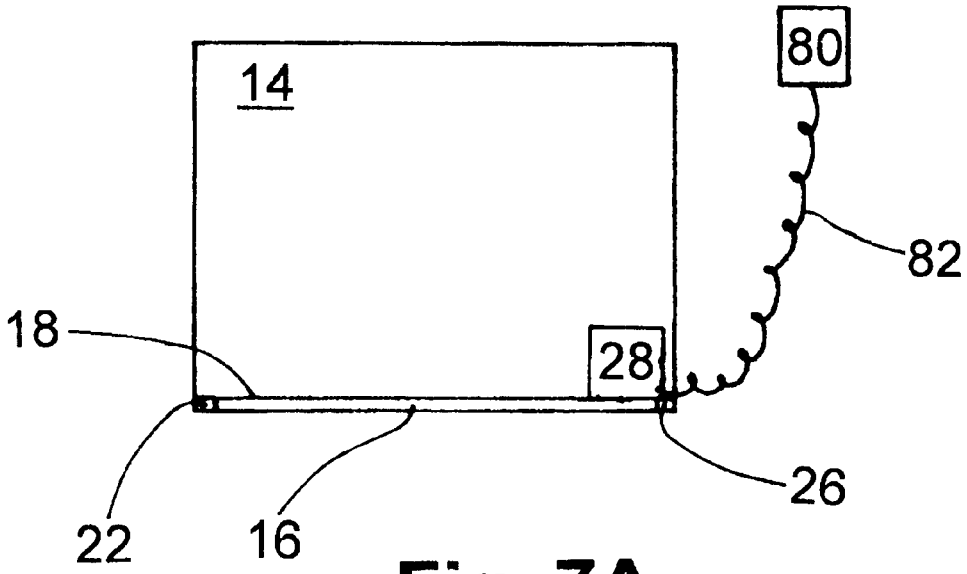
FIG. 7A is a front elevational view showing a door construction including a control box mounted on a sensing edge in accordance with the present invention.

FIG. 7A shows a door 14 having a sensing edge 16, an infrared transmitter 22, and an infrared receiver 26. Mounted on the sensing edge 16 mounting bracket or the leading edge 18 of the door 14 is a control box 28 housing all or at least portions of the control circuit 21 depicted in FIG. 4C. The control box 28 is preferably connected by a coiled cable 82 to the device responsible for actuation of the door 14. Power for the control box 28 may be delivered via cable 82 or by another cable (not shown), but it should be noted that the source of power is not critical to the present invention. The infrared transmitter 22 is connected to control box 28 by a cable 23 as shown in detail in FIG. 3. Infrared receiver 26 is connected to the control box 28 by a cable 27 as shown in detail in FIG. 3. The output signal from the control circuit 21 in control box 28 to the device 80 may be a switch, a dry contact from a normal single pole or double pole relay, a triac, an SCR, a transistor, optical signals, radio signals, or the like. The output signal from the control circuit 21 in the control box 28 may be any on/off signal as is known in the art.

Figure 7B:
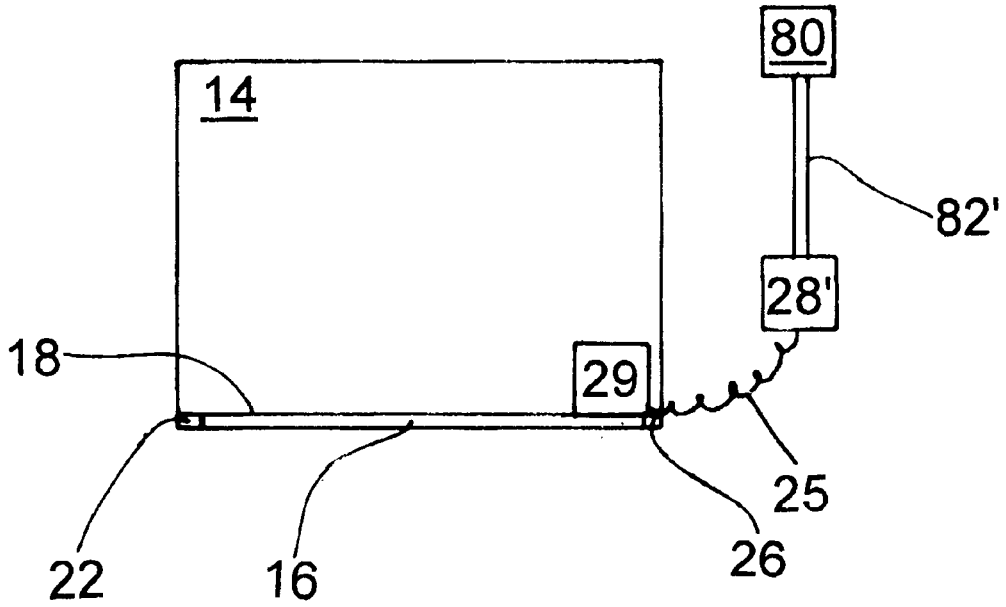
FIG. 7B is a front elevational view showing a door construction including a wall mounted control box in another embodiment of the present invention.

FIG. 7B shows an alternate embodiment wherein the door 14 having a leading edge 18 and a sensing edge 16 also includes an infrared transmitter 22, an infrared receiver 26, and local control box 29, and a wall mount control box 28'. The wall mounted control box 28' is connected by a cable or conduit 82' to the device 80 responsible for actuating the door 14. The local control box 29 is connected to the wall mounted control box 28' by a coiled control box cable 25. Power for the control circuit 21 in the control box 28' may be from the device 80 delivered by cable 82' or from another source not shown. A portion of the control circuit 21 or intermediate junction terminal blocks may be in local control box 29 to ease in connection from the local control box 29 to the wall mounted control box 28'. The infrared transmitter 22 is connected to the local control box 29 by transmitter cable 23 and infrared receiver 26 is connected to the local control box 29 by receiver cable 27.

The operation of the sensing edge 16 shall now be described. When no external pressure is applied to the sheath 30, the entirely hollow chamber 31 formed by the sheath 30 is unobstructed. Therefore, the infrared signal 24 transmitted as bursts of ten waveforms by the infrared transmitter 22 from the first end 30*a* of the sheath 30 freely passes toward the second end 30*b* of the sheath 30. Therefore, the infrared receiver 26 detects the presence of the infrared signal 24 at the second end 30*b* of the sheath 30 and consequently, does not send an output signal to the control circuit 21 which in turn does not send a failure signal to the device 80. In particular, the infrared receiver 26 does not transmit an output signal over the receiver cable 27 to the control circuit 21 located in the control box 28, and the control circuit 21 does not transmit a failure signal over the coiled cable 82 or by any other similar method to the device 80 for causing the door 14 to stop moving or to move to an open or safe position.

When an external pressure is applied to the sheath 30 because an article obstructs the downward or closing movement of the door 14, at least a portion of the sheath 30 is compressed into the hollow cavity 31. Such a compression of the sheath 30 is facilitated by the flexible material that forms the sheath 30 and by the air passageway 38 which allows air to escape freely from the hollow cavity 31. It should be understood that compression of the sheath 30 such that the hollow cavity 31 becomes blocked is caused by external pressure being applied at any angle and to any portion along the length of the sheath 30. As the portion of the sheath 30 is compressed into the cavity 31, the cavity 31 becomes blocked. Consequently, the infrared signal 24 transmitted by the infrared transmitter 22 is prevented from reaching the infrared receiver 26. Therefore, the infrared receiver 26 detects the absence of the infrared signal 24 and generates an output signal which is sent over receiver cable 27 to the control circuit 21 located in the control box 28. The control circuit 21 must count a predetermined number of clock cycles that the output signal is received by incrementing the hysterisis counter as shown in the flow diagram of FIG. 5. When a predetermined number is reached, the control circuit 21 sends a failure signal to the device 80 over the coiled cable 82 or by some other method, and the device 80 either stops the movement of the door 14 or moves the door to a safe position such as open. The control circuit 21 may then, but not necessarily, be required to be reset or cleared before the door may be closed. Alternatively, the control circuit 21 may reset automatically based upon the removal of the compression of the sheath 30 and the device 80 that actuates the door 14 may be set to a stop position until re-actuated.

From the foregoing, it can be seen that the present invention comprises a sensor system for a door having a transmitter, a receiver, a sensing edge and a control circuit capable of reducing detection errors due to noise or transients. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A sensor system for controlling movement of a door moving in a first direction by actuation of a device that controls movement of the door, the sensor system comprising:

(a) an elongated generally flexible tubular sheath secured to a leading edge of the door, the sheath having a longitudinal axis generally parallel to the leading edge of the door, and including an elongated hollow cavity extending generally parallel to the longitudinal axis, a first open end and a second open end;

(b) an infrared transmitter proximate the first end of the sheath configured to transmit an infrared signal toward the second end of the sheath through the cavity;

(c) an infrared receiver proximate the second end of the sheath in alignment with the infrared transmitter and being configured to detect the infrared signal at the second ends and to generate an output signal upon detecting an absence of the infrared signal when the passage of the infrared signal through the cavity is blocked; and (d) a control circuit coupled to the infrared receiver and configured to receive the output signal from the infrared receiver and to send a failure signal to the device only if no infrared signal is received by the receiver for a predetermined time period in excess of one pulse-width of time.

2. The sensor system of claim 1 wherein the output signal comprises a series of pulses each having a substantially similar width and with a predetermined time between pulses, the pulses being generated in the absence of the infrared signal detected by the receiver.

3. The sensor system of claim 2 wherein the control circuit includes a microcontroller having at least one input for receiving the output signal and at least one output for sending the failure signal, the microcontroller including a program for counting continuously repeating pulses of the output signal until a predetermined number of continuously repeating pulses accumulates and for causing the microcontroller to send the failure signal to the device.

4. The sensor system of claim 1 wherein the infrared signal and output signal are both binary.

5. The sensor system of claim 1 wherein the control circuit includes a microcontroller having at least one input for receiving the output signal.

6. The sensor system of claim 1 wherein the sheath includes a first support element and a second support element each extending from opposite edges of the sheath for securing the sheath to the door, and a second elongated hollow cavity for use as a wire way extending between the first support element, and the second support element.

7. The sensor system of claim 1 wherein the infrared transmitter transmits the infrared signal at a frequency of between about 28 kHz and about 59 kHz.

8. A sensor system for controlling movement of a door moving in a first direction by actuation of a device that controls movement of the door, the sensor system comprising:

(a) an elongated generally flexible tubular sheath secured to a leading edge of the door, the sheath having a longitudinal axis generally parallel to the leading edge of the door, and including an elongated hollow cavity extending generally parallel to the longitudinal axis, a first open end and a second open end; (b) a light wave transmitter proximate the first end of the sheath configured to transmit light waves toward the second end of the sheath through the cavity;

(c) a light wave receiver proximate the second end of the sheath in alignment with the light wave transmitter and being configured to detect the light waves at the second end; and to generate an output signal upon detecting an absence of the light waves when the passage of the light waves through the cavity is blocked; and (d) a control circuit coupled to the light wave receiver configured to receive the output signal from the light wave receiver and to send a failure signal to the device only if no light signal is received by the receiver for a predetermined time period in excess of one pulse-width of time.

9. The sensor system of claim 8 wherein the output signal comprises a series of pulses each having a substantially similar width and with a predetermined time between pulses, said pulses being generated in the absence of the light wave signal detected by the receiver.

10. The sensor system of claim 9 wherein the control circuit includes a microcontroller having at least one input for receiving the output signal and at least one output for sending the failure signal, the microcontroller including a program for counting continuously repeating pulses of the output signal until a predetermined number of continuously repeating pulses accumulates and for causing the microcontroller to send the failure signal to the device.

11. The sensor system of claim 8 wherein the output signal is binary.

12. The sensor system of claim 8 wherein the control circuit includes a microcontroller having at least one input for receiving the output signal.

13. The sensor system of claim 8 wherein the sheath includes a first support element and a second support element each extending from opposite edges of the sheath for securing the sheath to the door, and a second elongated hollow cavity for use as a wire way extending between the first support element, and the second support element.

14. In a sensing edge for controlling movement of a door moving in a first direction by actuation of a device that controls movement of the door upon force being applied to the sensing edge, the sensing edge comprising:

an elongate generally flexible tubular sheath secured to a leading edge of the door and having a longitudinal axis, the sheath including an elongated hollow cavity extending generally parallel to the longitudinal axis, a first open end and a second open end;

a transmitter configured to transmit light toward the second end of the sheath through the cavity and generally parallel to the longitudinal axis, the passage of the light through the cavity being blocked when external pressure is applied to a portion of the sheath to compress the sheath into the cavity; and a receiver configured to detect the light at the second end, and to generate an output signal upon detecting an absence of the light when the passage of the light through the cavity is blocked;

wherein the improvement comprises a control circuit coupled to the receiver and being configured to receive the output signal from the receiver and to send a failure signal to the device only if no light signal is received by the receiver for a predetermined time period in excess of one pulse-width of time.

* * * * *